US006055774A

United States Patent [19]

Muddiman

[11] Patent Number: 6,055,774

[45] Date of Patent: May 2, 2000

[54] EXPLOSION DOOR WITH IMPROVED MAGNETIC LATCH

[75] Inventor: G. Scott Muddiman, Burlington, Canada

[73] Assignee: Process Equipment Inc., Burlington, Canada

[21] Appl. No.: 09/324,514

[22] Filed: Jun. 3, 1999

[30] Foreign Application Priority Data

Jun. 10, 1998 [CA] Canada ..... 2240215

[51] Int. Cl.[7] ..... E05B 65/10

[52] U.S. Cl. ..... 49/141; 52/196

[58] Field of Search ..... 49/141, 501, 31, 49/364, 379, 463; 52/196

[56] References Cited

U.S. PATENT DOCUMENTS

| | | | |
|---|---|---|---|
| 3,340,650 | 9/1967 | Sackett | 49/463 |
| 3,376,669 | 4/1968 | Johnston | 49/463 X |
| 5,369,394 | 11/1994 | Quirk et al. | 49/31 X |
| 5,769,145 | 6/1998 | Kwatonowski | 49/141 X |

FOREIGN PATENT DOCUMENTS

| | | | |
|---|---|---|---|
| 589463 | 11/1933 | Germany | 52/196 |
| 158458 | 1/1933 | Switzerland | 52/196 |

*Primary Examiner*—Jerry Redman
*Attorney, Agent, or Firm*—McFadden, Fincham

[57] ABSTRACT

An explosion door including a frame and door panel includes an improved latch mechanism for releasably securing the door panel to the frame with a retainer bar. The latch includes a pivoting latch housing having at a free end a magnetic contact and latch stop for contacting the retainer bar. A seal between the door panel and frame includes a rigid door stop component and a resilient seal. The retainer bar is mounted to the frame to permit the spacing between the bar and door panel to be adjusted in a stepwise manner.

4 Claims, 5 Drawing Sheets

EXPLOSION DOOR WITH IMPROVED MAGNETIC LATCH

FIELD OF THE INVENTION

The present invention relates to an explosion door, comprising a frame having a releasably secured to the frame door and which opens to provide a vent in the event of an explosion within an enclosed chamber such as a silo, hopper, bin, etc. A releaseable latch holds the door shut during normal operation, with the latch adapted to open in the event of an explosion or other sudden increase in pressure.

BACKGROUND OF THE INVENTION

Explosion vents and doors are frequently installed in silos, hoppers, bins, dryers and other large chambers for handling of bulk materials, that can potentially experience a destructive explosion. In order to prevent damage or destruction to the structure and the accompanying safety hazards and financial losses, an explosion vent or door is installed to vent the expanding gases during the explosion. Typically the vent or door is secured and sealed during normal operation of the chamber, and opens only in the event of a sudden increase in pressure such as an explosion. A typical explosion door comprises a frame for mounting within a corresponding opening within the wall of the chamber. A door panel is releasably secured to the frame. In one type of explosion door, the door panel is held against the frame by a releasable latch which retains the door in the shut position during normal operation of the chamber. A seal between the door and the chamber is provided.

The latch permits the door to burst open in the event of a sudden increase in internal pressure within the chamber, indicative of an explosion. Conveniently, adjustable means are provided to permit the user to adjust the securing means to permit the door to open at a selected burst pressure. Typically, the latch permits the door to open at a selected pressure in the range of a 0.5– 2.0 psig. The area of the door should be large enough to vent the enclosure sufficiently to limit structural damage.

Conventional latch-type explosion door systems typically include a retainer bar spanning the frame and spaced apart from the outer face of the door panel. The bar is hinged at one end to a first side of the frame and at the other end is latched with a releaseable latch to the opposing side of the frame. Release of the bar from the latch permits the door to open. An array of springs or other biasing means between the bar and the door panel retains the door in the shut position. Conveniently, the biasing means are adjustable. The latch is actuated by a an actuator rod between the door and the latch whereby when sufficient pressure acts outwardly on the door to counteract the biasing means such that the door partly opens, the latch is released and the door is permitted to fully open to permit the release of the excess gas pressure.

The latch structure of the prior art devices typically comprises an elongate latch housing hinged at one end to the retainer bar and engaging a frame member (as seen in FIG. 1(*a*) and 1(*b*), with the opposing end extending when the latch is in the closed position towards the opposing frame member. The latch housing incorporates a magnet stop bar, which in turn is hinged to the interior of the latch housing, for magnetic contact with a magnet mounted to the retainer bar. The hinged connection between the magnetic stop bar and the latch housing is required in order to permit the exposed flat face of the magnetic bar to make a solid, parallel contact with the stop member Typically, the actuator rod contacts the latch housing at a position between the magnetic bar and the latch housing hinge. The length of the actuator rod is adjustable to reflect the spacing between the retainer bar and the door panel, which in turn permits adjustment of the burst pressure required to open the door.

A drawback of the conventional latch mechanism described above resides in the difficulty of opening and closing the latch as a result of uneven contact between the retainer bar and the hinged magnetic bar. Further, the hinged member renders difficult the making of a consistently solid contact between the latch housing and the retainer bar.

In a further aspect of the conventional devices, the seal between the door and the housing comprises a an extrusion having a U-shaped profile, the flanges of which mount to the inner and outer faces, respectively, of the door panel. A flexible and resilient seal member is attached to the exterior of the extrusion for contact with the frame. This arrangement is relatively costly to manufacture, and as well potentially permits leakage between the inner flange and the door panel. Accordingly, it is desirable to provide a seal wherein these drawbacks are addressed.

A further aspect of the prior art explosion doors resides in the means by which the actuator rod is mounted to the door. In the prior art, this component is bolted to the door panel, by means of a bolt that extends through the door panel. The resulting opening through the panel impairs the integrity of the door panel. Accordingly, it is desirable to provide an explosion door having an minimum of intrusions extending in through the door into the interior of the chamber.

SUMMARY OF THE INVENTION

It is an object of the present invention to provide an explosion door having an improved magnetic latch mechanism that provides consistent and positive contact between the magnet and magnet stop, and which may be opened and closed with relative ease by a user. It is a further object to provide an improved seal between the door panel and door frame of an explosion door, which is relatively simple to manufacture and provides improved sealing capabilities. It is a further object to provide a latch mechanism wherein the spacing between the door panel and retainer bar spanning the door may be adjusted by way of a step-wise adjustment means that permits consistent spacing between these members.

In light of the foregoing objects, the present invention consists in one aspect of an explosion door arrangement consisting of a frame and door panel. A seal is provided between the frame and door The door is releasably secured to the frame by means of a latch mechanism, comprising a retainer bar spanning the door and hinged at one end to a first frame member, and releasably latched at an opposing end to a second, opposing frame member. The retainer bar is spaced apart from the upper face of the door. The releaseable latch comprises a generally elongate latch housing hinged at a proximal end to the retainer bar, and engaging the frame when in a closed position. The distal free end of the latch housing contacts the retainer bar when in the closed position and is releasably engaged thereto by a magnet, which contacts and engages a magnet stop. The magnet and magnet stop respectively provide stop means for the latch housing, and are positioned at the distal end of the latch housing. The latch is released when outward pressure on the inner face of the door causes the door to move upwardly relative to the frame, the upward motion being transmitted to the latch housing by means of an actuator rod extending upwardly from the outer face of the door, through an opening within the latch bar and contacting the latch housing at a position proximally to the magnet and magnet stop.

Biasing means, such as one or more springs, between the outer face of the door panel and the latch bar bias the door panel downwardly against the frame, and are adjustable to permit the user to trigger release of the door at differing burst pressures. The improvement in this aspect of the invention consists of the latch actuator being positioned proximally of the magnet and magnet stop, permitting the use of a relatively small magnet at the distal end of the latch housing, and wherein the magnet and magnet stop are fixedly mounted to the latch housing and retainer bar respectively.

In a further aspect, a seal is provided around the perimeter of the door, and comprises a rigid generally plate-like member mounted to the edge of the door panel and extending downwardly below the inner face of the door panel. The lower edge of the member abuts the frame when closed and comprises a stop member for the door panel. A seal member, comprising a resilient material, is mounted around the perimeter of the door panel on the inner face thereof, and adjacent the stop member. The stop member is positioned to limit compression of the seal when the door panel is secured. In this manner, the spacing between the door panel and door frame is fixed when the door is in the shut position.

In a further aspect, the mounts that attach the hinged end of the retainer bar and the latch, respectively, to the door frame each comprise a mount plate engagable to the door frame by means of one or more bolts extending through the latch plate and door frame. In either or both the mount plate and frame, each bolt is in one of an array of apertures for mounting the mount plates in multiple positions relative to the frame, whereby the vertical position of the mount plates relative to the frame may be adjusted in a series of discrete steps.

The directional references used here refer to the door in a horizontal position, with the inner face of the door, which normally faces the interior of the chamber, facing downwardly. It will be understood that in use, the door may be positioned in any orientation.

DETAILED DESCRIPTION OF THE PREFERRED EMBODIMENTS

Figure 1A:
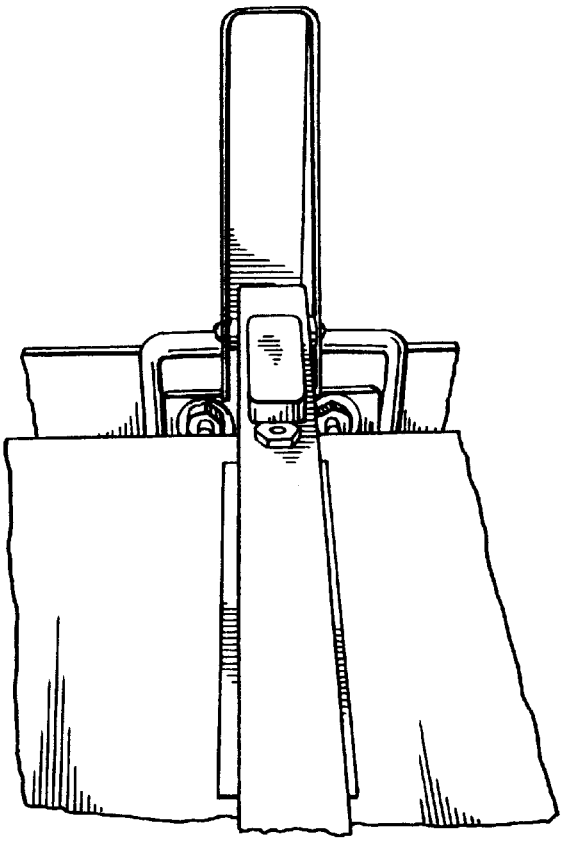
FIG. 1a PRIOR ART
FIG. 1*a* is a perspective view of a portion of a typical prior art explosion door.
Figure 1B:
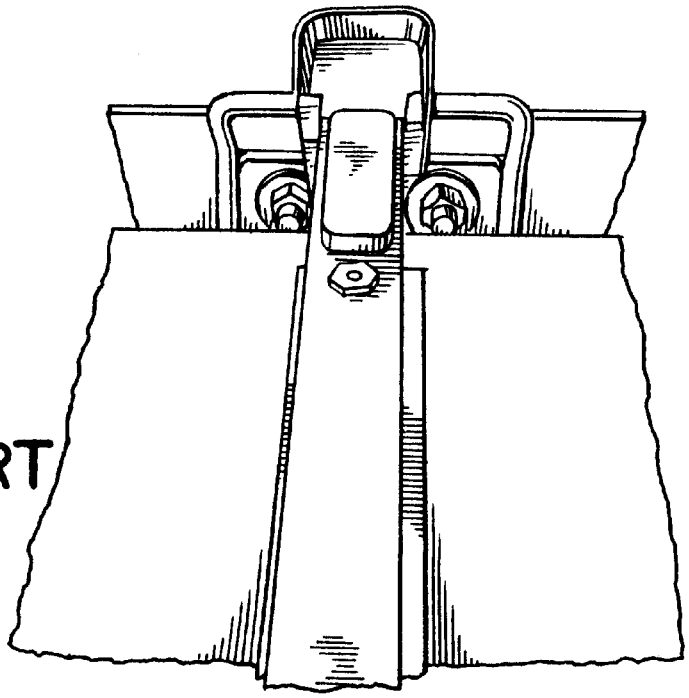
FIG. 1b PRIOR ART
FIG. 1*b* is a further perspective view according to FIG. 1*a;*
Figure 2:
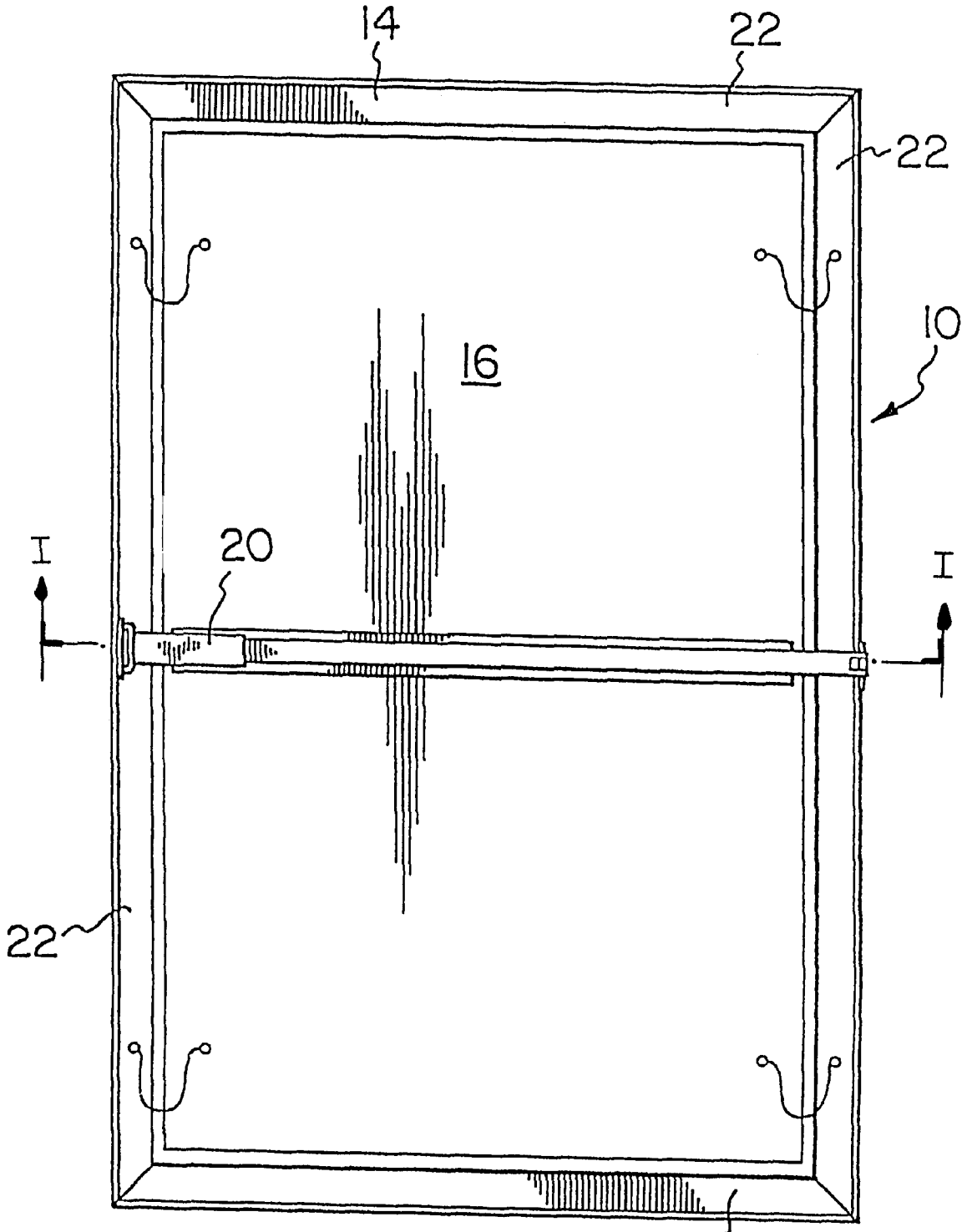
FIG. 2 is a plan view of an explosion door according to the present invention.

The apparatus, generally denoted by reference no. 10, consists broadly of a frame 14, a door panel 16 realeasably engaged to the frame, and a latch mechanism 20 for realeasably securing the door panel to the frame. The frame may be mounted within an opening within a wall of a chamber, for example a grain silo, chemical processing chamber or the like wherein the processes carried out within the chamber present a risk of explosion. Conveniently, the frame is fabricated from relatively heavy gauge steel plate, and comprises four frame members 22 forming a rectangle Each frame member 22 is generally L-shaped when seen in cross section, as in FIG. 3, and comprises a horizontal frame plate 24 and a vertically extending flange 26. The door panel may conveniently comprise a relatively rigid and light-weight composite structure comprising upper and lower aluminum skins 30 sandwiching an aluminum honey-comb interior 32.

Figure 3:
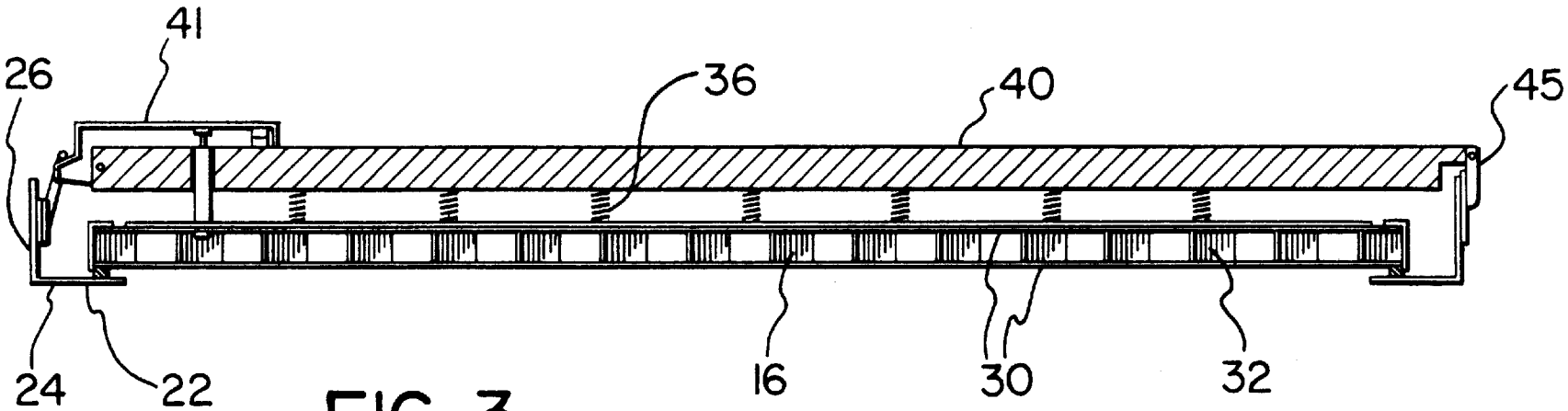
FIG. 3 is a sectional view along line I—I of FIG. 2.

The latch arrangement comprises a retainer bar 40 engaged at either end to opposing frame members and traversing the frame. As seen in FIG. 3, the retainer bar is spaced from the upper face of the door, and an array of springs 36 or other biasing means are positioned between the bar and the door. Conveniently, the springs are removable, and the degree of biasing is determined by the number and strength of the springs, as well as the spacing between the door panel and retainer bar, which determines the compression of the springs. When the bar is in the closed position, the springs retain the door in the closed position. Sufficient increase in air pressure within the chamber, caused for example by an explosion, pushes the door panel upwardly relative to the frame, counteracting the biasing means. Sufficient upward movement of the panel releases the latch mechanism as will be described below, permitting the release of the door panel from the frame. This opens the vent and releases pressure from the chamber.

The retainer bar 40 is hinged at one end by means of a hinge 45 to a first frame member and realeasably engaged at its opposite end by means of a latch 41 to an opposing frame.

Figure 4:
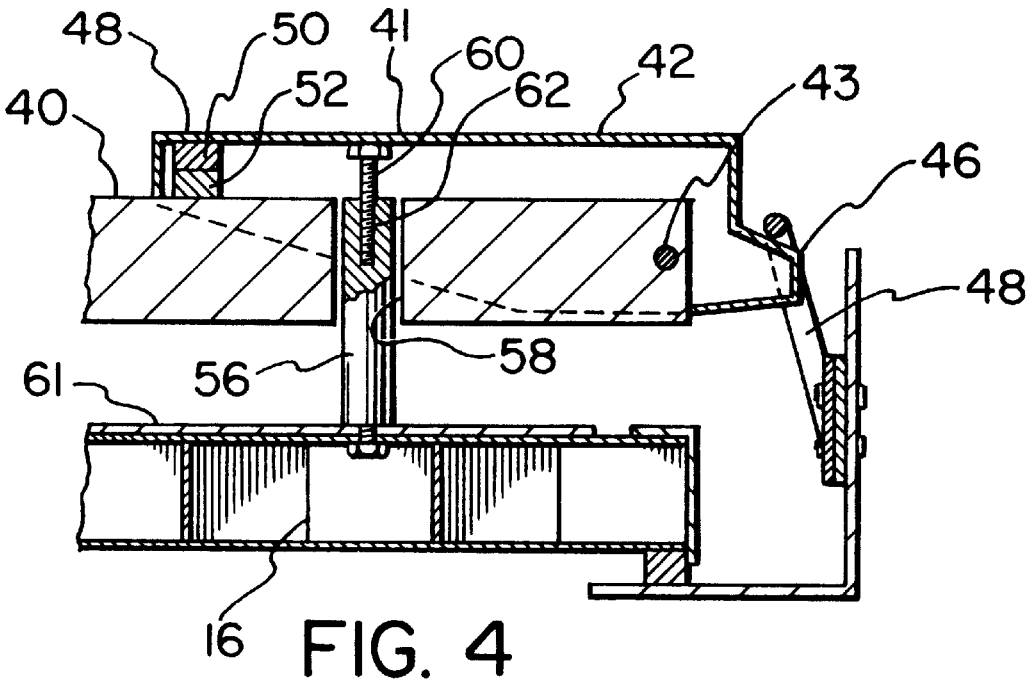
FIG. 4 is a sectional view of a portion of the device, illustrating the latch mechanism.
Figure 5:
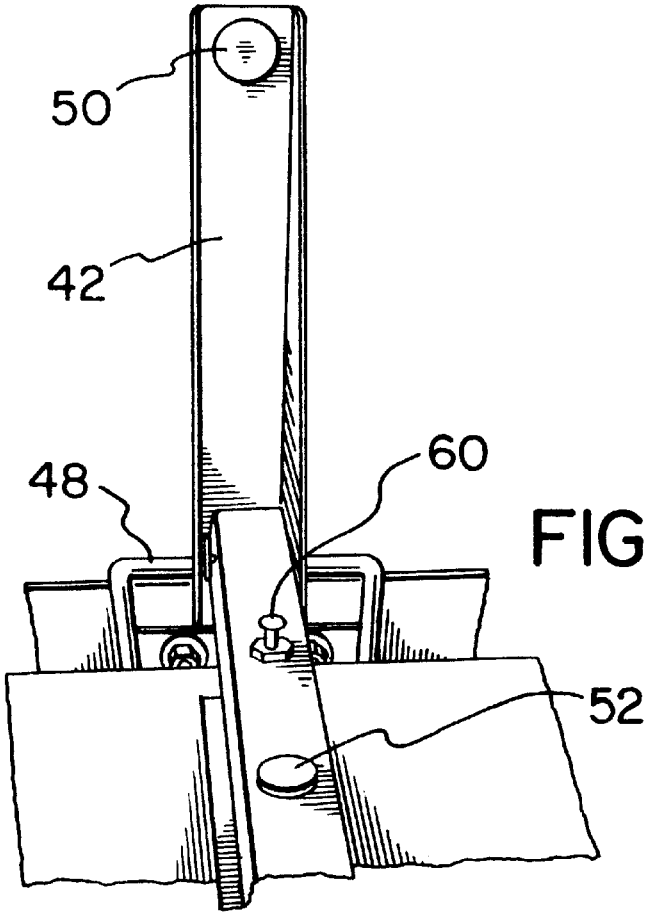
FIG. 5 is a perspective view illustrating the latch mechanism.

Turning to FIGS. 4 and 5, the latch 41 comprises a latch housing 42, pivotally mounted at its proximal end by pivot mount 43 to the retainer bar, adjacent an end of the bar. The housing includes a spur 46 extending outwardly past the end of the retainer bar and adapted to engage a corresponding catch 48 mounted to the frame member. When the latch housing is in the lowered position shown in FIG. 4, the spur engages the catch and retains the latch housing 42 in a closed position. Release of the spur from the catch occurs when the housing is in the open position.

The proximal end 48 of the latch housing features a magnet 50 mounted within the interior of the housing, and positioned to contact a stop member 52 mounted to the retainer bar 40. It will be seen that the relative positions of the stop member and magnet may be reversed, whereby the magnet is mounted to the retainer bar and the stop mounted to the housing. The magnet and stop retain the latch in a closed position until released by upward movement of the door panel.

A latch actuator comprises a cylindrical member 56 mounted to the upper face of the door and extending upwardly therefrom. An aperture 58 extending through the retainer bar 40 permits the actuator to extend therethrough. The upper end of the actuator terminates in a bolt 60 engaged within a co-axial central threaded opening 62 within the actuator, whereby threading the bolt into or out of the actuator adjusts the length of the actuator. The upper end of the actuator is positioned for contact with the interior of the latch housing, whereby upward movement of the door causes a corresponding upward movement of the actuator and upward pressure against the latch housing. Sufficient upward movement of the actuator releases the latch housing, and permits the latch bar to open. The latch actuator is positioned to contact the latch housing at a position between the magnet and latch housing pivot mount 43.

The actuator is mounted to the door panel by means of a mount plate 61, which in turn is bolted to the upper skin of the door panel. The mount plate may also serve as a backstop for the springs. The provision of a mount plate distributes the forces between the actuator and the door panel, and permits the actuator to be mounted to the panel without a bolt hole extending through the panel.

Figure 6:
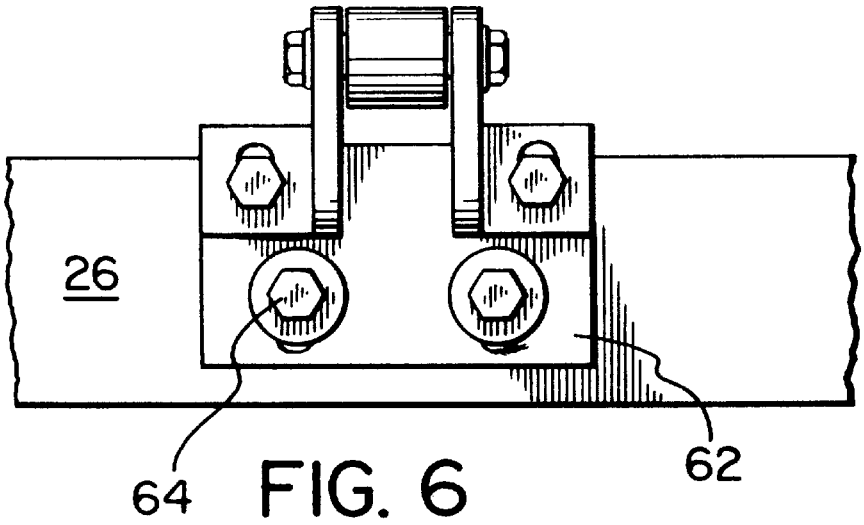
FIG. 6 is a side elevational view of a portion of the device, showing the hinge portion.
Figure 7:
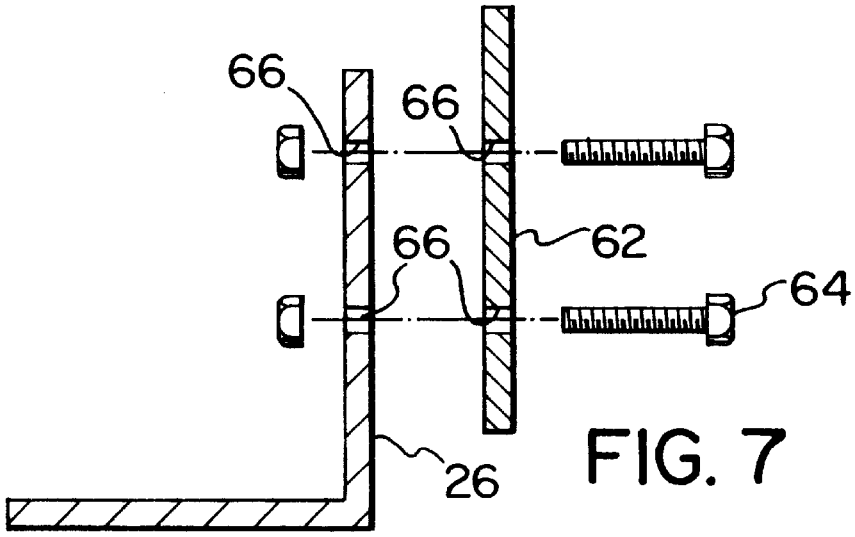
FIG. 7 is a sectional as in FIG. 6, showing the hinge plate and bolts.

The catch 48 and retainer bar hinge 45 are each mounted to a respective frame member, as shown in FIGS. 4, 6 and 7 in the manner whereby the spacing between the retainer bar 40 and the door panel may be adjusted in a series of discrete steps. This is accomplished by providing a mount plate 62 for each of the hinge and catch, for attachment to the flange of the frame. The attachment means in each case comprises a bolt and nut arrangement 64 threaded through apertures 66 within the mount plate and flange 26 respectively. The step-wise adjustment feature is provided by means of multiple vertically arranged bolt apertures within either of the flange or plate, that permit the user to select a position for mounting the plate to the flange.

Figure 8:
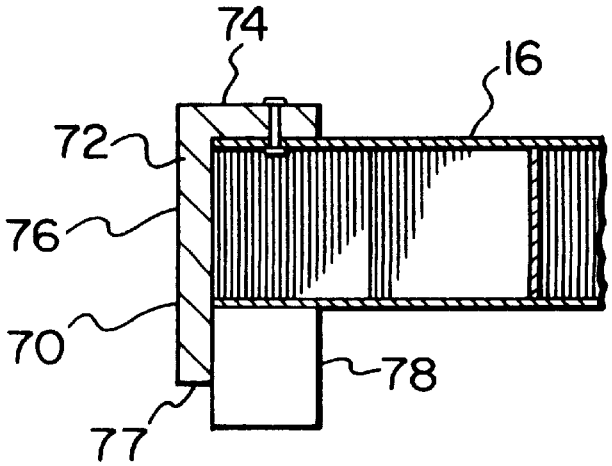
FIG. 8 is a sectional view of a portion of the door structure.

Referring to FIG. 8, the perimeter of the door panel includes a seal 70, for maintenance of a sealed relationship between the door and the frame when the door is in the closed position. The seal structure comprises a seal stop member 72 comprising a rigid generally L-shaped structure, conveniently comprising an aluminum extrusion. A first plate-like limb 74 of the stop member is riveted or otherwise fixedly mounted to the upper face of the door. A second plate-like limb 76 covers the exposed edge of the door panel and extends downwardly below the lower face of the door panel. The lower exposed edge 77 of the second limb contacts the horizontal plate of the door frame, when the door panel is in the closed position. The lower edge 77 provides a positive contact between the door panel and the frame.

A seal member, 78 comprising a cellular foam material or other resilient material, is glued or otherwise fastened to the lower face of the door panel around the periphery of the door panel. The seal has a sufficient thickness to extend below the lower edge 77 of the stop member, when the seal is uncompressed. In the closed position of the door panel, the stop member limits compression of the seal.

It will be seen that although the present invention has been described by way of a preferred embodiment, numerous departures from and variations to the invention may be made without departing from the spirit and scope of the invention.

I claim:

1. A pressure release door assembly comprising:

a frame comprised of frame members and defining a door opening, a door panel for spanning said door opening;

a retainer bar spanning opposing frame members for retaining said door panel to said frame;

latch means for releasably engaging said retainer bar to said frame, said latch means comprising an elongate latch housing hinged at a proximal end to said retainer bar, a magnet and magnet stop respectively mounted to one of said housing retainer bar at a distal end of said housing;

an actuator extending from said door panel and positioned to contact said housing proximally of said magnet and magnet stop to release said latch housing from said retainer bar when pressure on said door panel forces said door against said retainer bar.

2. A door assembly as in claim 1, further comprising seal means between said door panel and said frame members, said seal means comprising a rigid stop member extending around the periphery of said door panel and extending downwardly below the lower face of said door panel, and a seal member attached to an inner face of said door panel adjacent said stop member.

3. A door assembly as in claim 1, further comprising adjustable mount means for fastening said retainer bar and said latch means to said frame, whereby said retainer bar may be spaced from said door panel with a step-wise adjustment means.

4. A door assembly as in claim 1, further comprising a mount plate fastened to an upper skin of said door panel, said mount plate for mounting said actuator to said door panel.

* * * * *